US007246561B2

(12) United States Patent
Weatherly

(10) Patent No.: US 7,246,561 B2
(45) Date of Patent: Jul. 24, 2007

(54) ADJUSTABLE FURNITURE ASSEMBLY

(75) Inventor: Matthew Weatherly, Belton, MO (US)

(73) Assignee: O'Sullivan Industries, Inc., Lamar, MO (US)

( * ) Notice: Subject to any disclaimer, the term of this patent is extended or adjusted under 35 U.S.C. 154(b) by 527 days.

(21) Appl. No.: 10/365,045

(22) Filed: Feb. 12, 2003

(65) Prior Publication Data

US 2004/0154499 A1 Aug. 12, 2004

(51) Int. Cl.
*A47B 11/00* (2006.01)

(52) U.S. Cl. ..... 108/137; 312/201; 312/205

(58) Field of Classification Search ..... 108/143, 108/137, 102, 107, 147.17, 147.16; 248/298.1, 248/250, 241, 247–249; 312/205, 201, 203; 211/90.02, 206, 126.15, 175; 5/2.1, 8.1, 5/8, 661

See application file for complete search history.

(56) References Cited

U.S. PATENT DOCUMENTS

| | | | | | |
|---|---|---|---|---|---|
| 1,161,934 | A | * | 11/1915 | Gilmore | 312/205 |
| 2,628,145 | A | * | 2/1953 | Slattery | 312/205 |
| 2,721,336 | A | * | 10/1955 | Becker | 5/2.1 |
| 3,011,180 | A | * | 12/1961 | Majeski | 5/9.1 |
| 3,059,780 | A | * | 10/1962 | Anka | 108/107 |
| 3,316,564 | A | * | 5/1967 | Rogers, Jr. | 5/9.1 |
| 4,109,328 | A | * | 8/1978 | Mason | 5/2.1 |
| 4,138,175 | A | * | 2/1979 | Tattershall | 312/408 |
| 4,178,844 | A | * | 12/1979 | Ward et al. | 211/175 |
| 4,232,411 | A | * | 11/1980 | Speyer | 5/8 |
| 5,065,873 | A | * | 11/1991 | Tseng | 108/107 |
| 5,253,837 | A | * | 10/1993 | Loux | 248/250 |
| 5,303,057 | A | | 4/1994 | Davidow et al. | |
| 5,572,751 | A | * | 11/1996 | Brandt | 5/9.1 |
| 5,795,041 | A | | 8/1998 | Weaver | |
| 5,865,517 | A | * | 2/1999 | Wang | 211/175 |
| 5,947,569 | A | * | 9/1999 | Rheault et al. | 312/194 |
| 6,230,909 | B1 | * | 5/2001 | Suter | 211/188 |
| 6,283,563 | B1 | | 9/2001 | Lambright et al. | |
| 6,374,754 | B1 | * | 4/2002 | Chang | 108/92 |
| 6,402,272 | B1 | | 6/2002 | Kuvshinikov | |
| 6,568,001 | B2 | * | 5/2003 | Walsh | 5/2.1 |
| 6,648,155 | B1 | * | 11/2003 | Wang | 108/107 |
| 6,776,466 | B2 | * | 8/2004 | Harvie, III | 248/250 |
| 6,877,826 | B2 | * | 4/2005 | Wood et al. | 312/205 |
| 6,896,341 | B2 | * | 5/2005 | Cattoire | 312/205 |
| 2003/0102788 | A1 | * | 6/2003 | Dallman et al. | 108/107 |

FOREIGN PATENT DOCUMENTS

| | | | | |
|---|---|---|---|---|
| EP | 493661 | * | 7/1992 | |
| FR | 2703226 | * | 10/1994 | 312/205 |

* cited by examiner

*Primary Examiner*—Jose V. Chen
*Assistant Examiner*—Hanh V. Tran
(74) *Attorney, Agent, or Firm*—Haynes and Boone, LLP; Dave R. Hofman

(57) ABSTRACT

An adjustable furniture assembly having a support structure for receiving a bridge of the furniture assembly is described. The support structure includes a horizontal support member which receives the bridge in a slidable engagement to provide the furniture assembly with adjustability in a right or left direction. The horizontal support member is further adjustable to provide the furniture assembly with adjustability in a vertical direction.

9 Claims, 4 Drawing Sheets

*Fig. 1*

ADJUSTABLE FURNITURE ASSEMBLY

BACKGROUND

The present disclosure relates generally to a furniture assembly, and more particularly to a furniture assembly having an arrangement for adjusting the size of the furniture assembly.

Appliances, such as televisions, stereos, and the like, are often housed in furniture assemblies. Such assemblies provide an area that may be decorated as well as a place for storing various media. Due to the plethora of currently available appliances, it is desirable to have a furniture assembly that is adjustable to accommodate appliances of different sizes.

Current adjustable furniture assemblies are complex, in that they require bolts, pins, or other mechanical fasteners, as well as complex machining to effectuate adjustability.

Therefore, what is needed is a furniture assembly having an improved arrangement for adjusting the size of the furniture assembly.

DESCRIPTION

Figure 1:
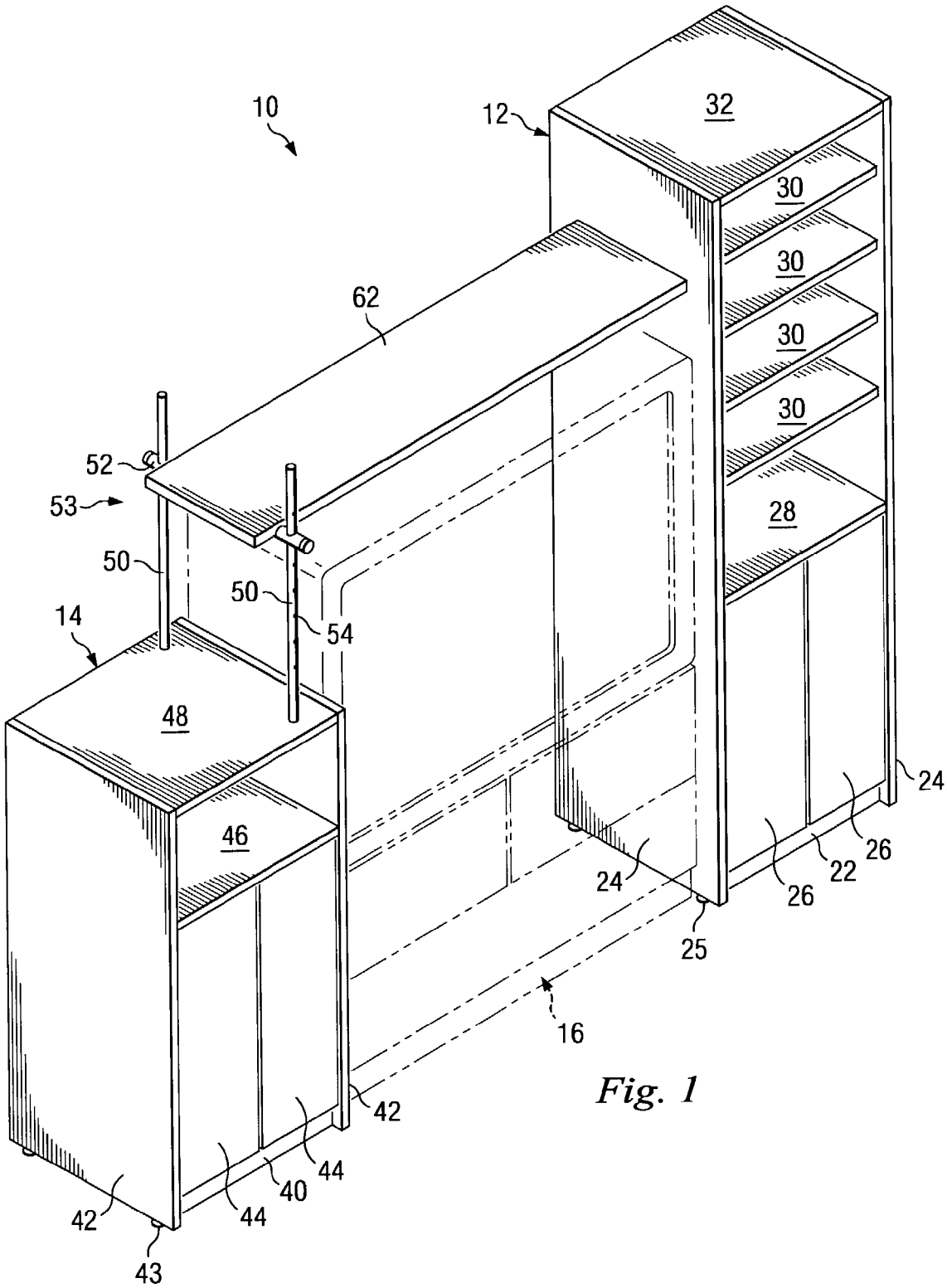
FIG. 1 is a perspective view of a furniture assembly according to one embodiment of the present disclosure.

Referring to FIG. 1, an adjustable furniture assembly is generally referred to by reference numeral 10. The furniture assembly 10 includes a pair of spaced apart towers 12 and 14 for housing a variety of appliances. For instance, a television 16, as is illustrated in phantom in FIG. 1, is disposed between the towers 12 and 14. The tower 14 is shorter than the tower 12 for reasons to be described.

The tower 12 includes a base 22 and a pair of sidewalls 24 extending vertically from the base. A plurality of sliders 25 are disposed on the base 22 for contacting the tower 12 with a ground surface (not depicted).

A pair of doors 26 are pivotally connected to the sidewalls 24, respectively, via any conventional means. A horizontal cover plate 28 is mounted between the sidewalls 24 in any conventional manner at the top edge of the doors 26. The cover plate 28 serves as a shelf for the furniture assembly 10.

A plurality of horizontally-extending, vertically-spaced shelves 30 are mounted between the sidewalls 24 in any conventional manner in an area above the cover plate 28. Furthermore, a horizontal top plate 32 is mounted between the sidewalls 24 in any conventional manner.

The tower 14 includes a horizontal base 40 and a pair of sidewalls 42 extending vertically from the base. A plurality of sliders 43 are disposed on the base 40 for contacting the tower 14 with a ground surface (not depicted).

A pair of doors 44 are pivotally connected to the sidewalls 42, respectively, via any conventional means. A horizontal cover plate 46 is mounted in any conventional manner between the sidewalls 42 at the top edge of the doors 44. The cover plate 46 serves as a shelf for the furniture assembly 10. A horizontal top plate 48 is further mounted between the sidewalls in any conventional manner.

A pair of horizontally-spaced, vertically-extending support members 50 and a horizontal support member 52 cooperate to decfine a support structure 53. The vertical support members 50 and the horizontal support member 52 are formed as tubes. The vertical support members 50 are releasably secured to the top plate 48 of the tower 14 via a threaded connection and are adapted to receive the horizontal support member 52 in a releasable engagement. The horizontal support member 52 will be further described with reference to FIGS. 2-6.

A plurality of threaded apertures 54 are formed in the vertical support members 50 for aiding the releasable engagement between the vertical support members and the horizontal support member 52 as will be further described with respect to the operation.

The horizontal support member 52 is adapted to receive a bridge 62, which extends from the tower 12. The bridge 62 is releasably connected to the tower 12 via cap screws (not depicted).

Figure 2:
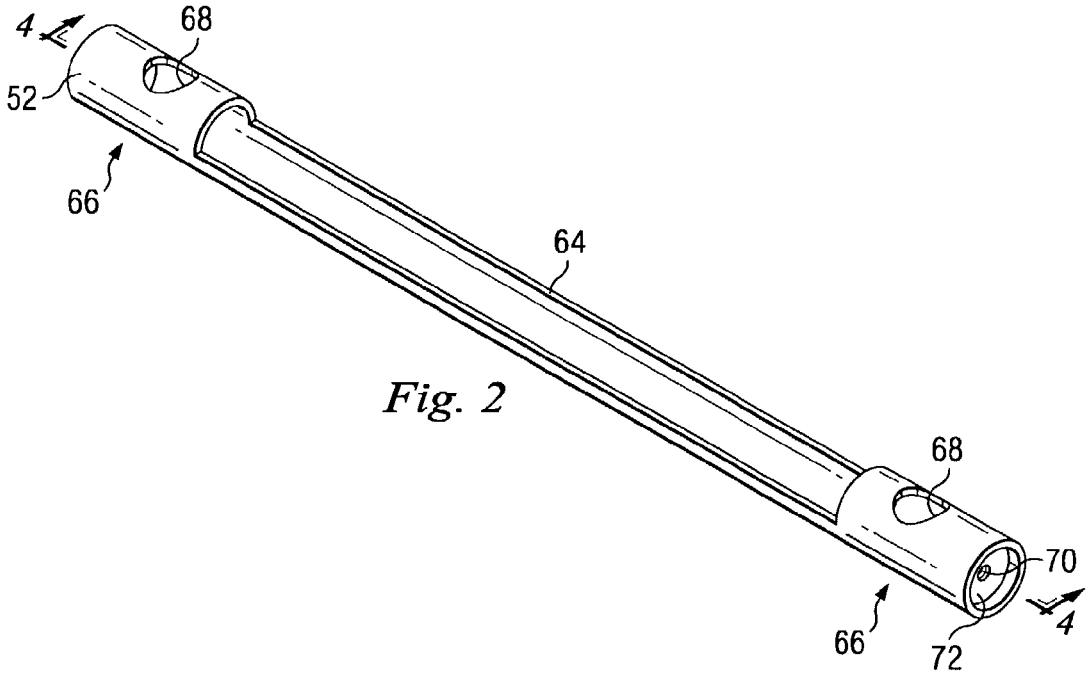
FIG. 2 is a perspective view of a horizontal support member of the furniture assembly of FIG. 1.
Figure 3:
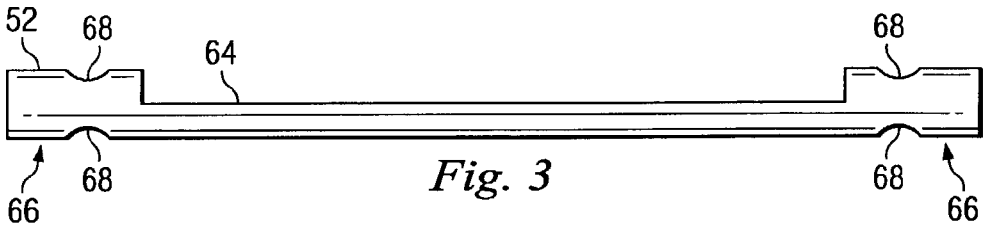
FIG. 3 is a front view of the horizontal support member of FIG. 2.
Figure 4:
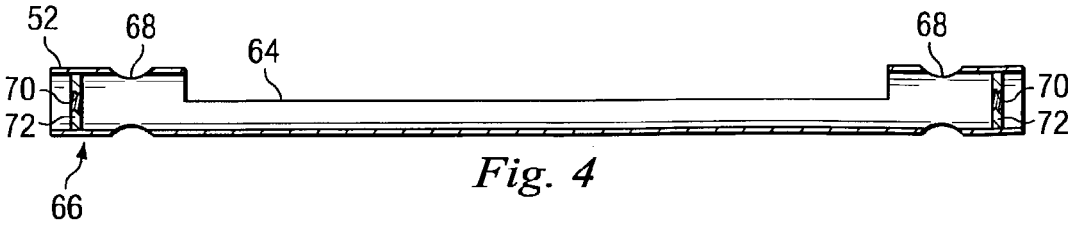
FIG. 4 is a cross-sectional view of the horizontal support member of FIG. 2 taken along the line 4-4.

Referring to FIGS. 2-4, a groove 64 is formed in the middle of the horizontal support member 52 for receiving the bridge 62 (FIG. 1) in a slidable engagement. The groove 64 defines a pair of end portions 66 of the horizontal support member 52. A pair of diametrically opposed apertures 68 are formed radially through the end portions 66 to engage the horizontal support member 52 with the vertical support members 50 (FIG. 1).

Figure 5:
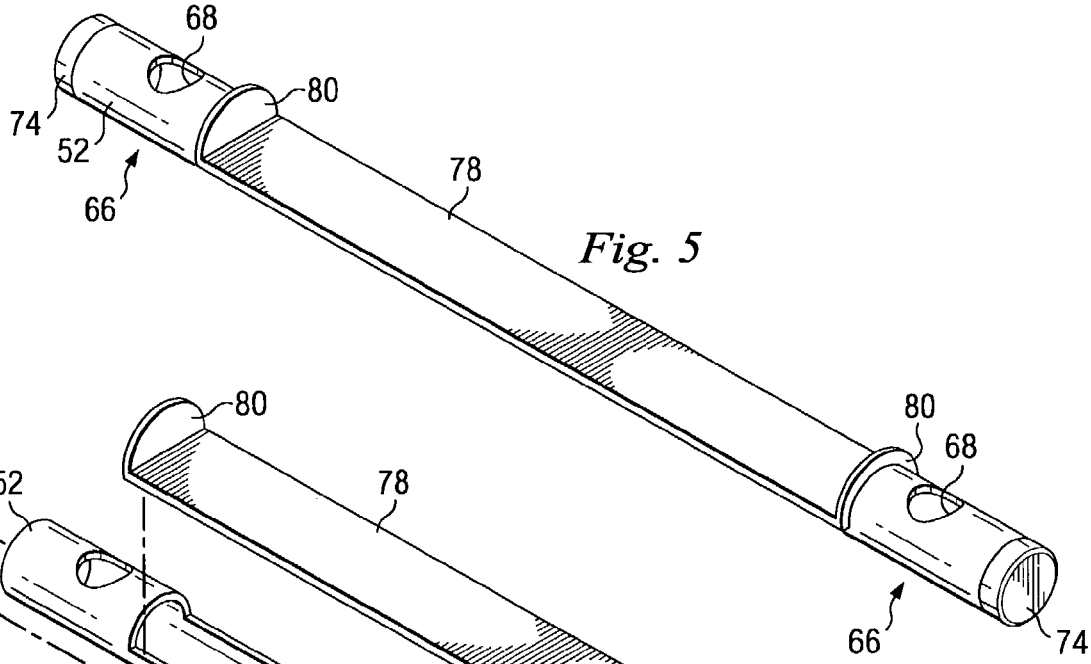
FIG. 5 is a perspective view of the horizontal support member of FIG. 2 with additional elements.
Figure 6:
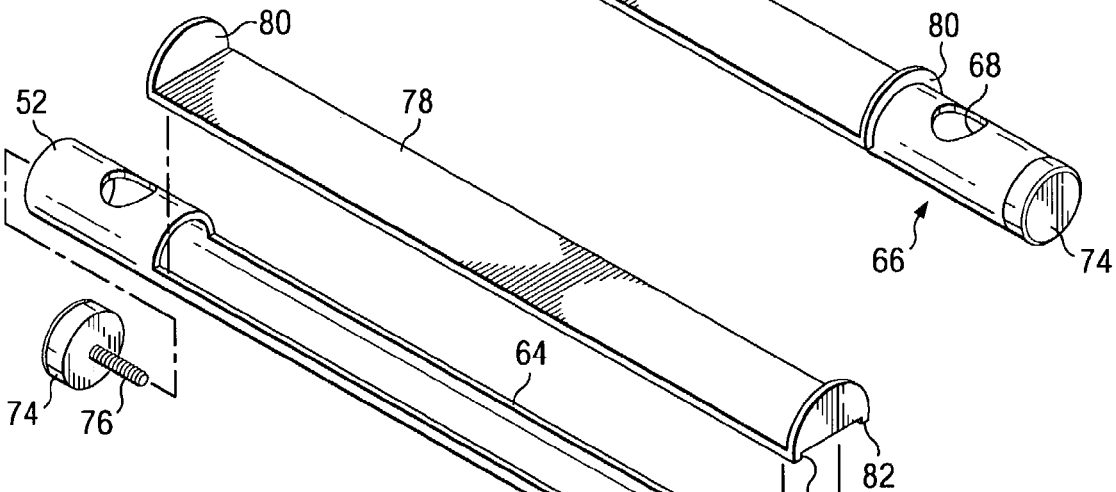
FIG. 6 is an exploded view of the horizontal support member of FIG. 5.
Figure 7:
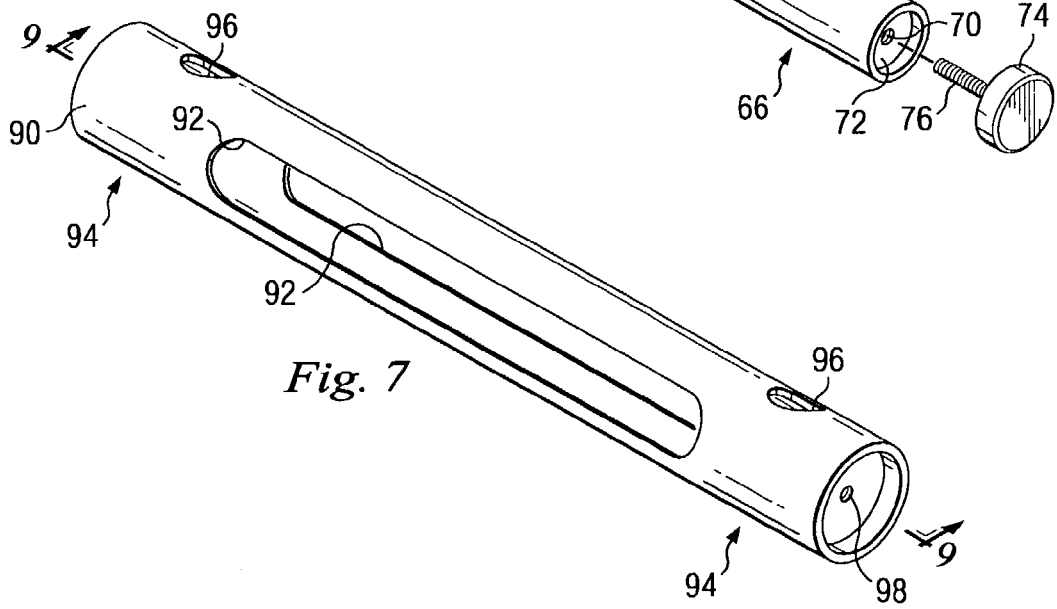
FIG. 7 is a perspective view of a horizontal support member according to an alternative embodiment of the present disclosure.
Figure 8:
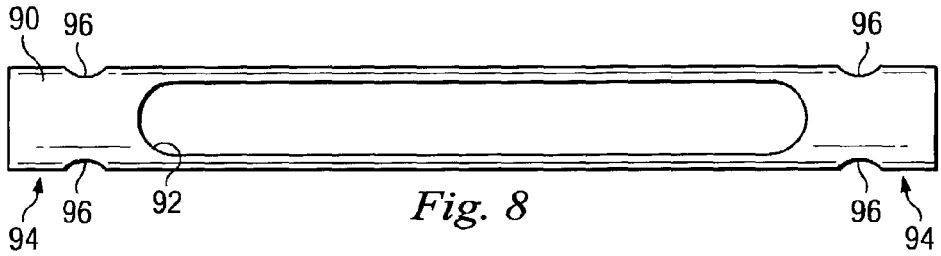
FIG. 8 is a front view of the horizontal support member of FIG. 7.
Figure 9:
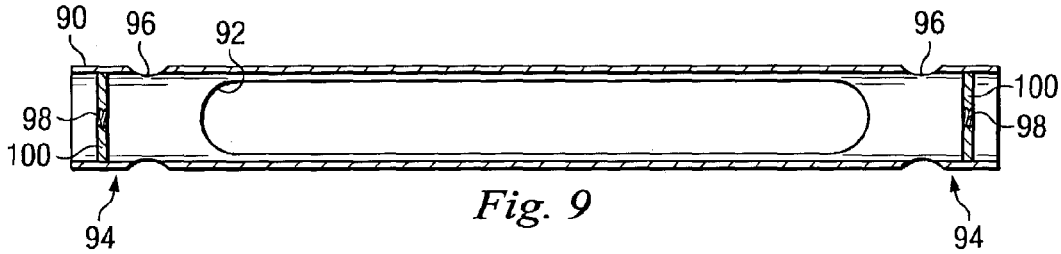
FIG. 9 is a cross-sectional view of the horizontal support member of FIG. 7 taken along the line 9-9.

A threaded bore 70 is formed longitudinally through a solid portion 72 of the end portions 66 for receiving a pair of end caps 74 (FIGS. 5 and 6). Referring to FIGS. 5 and 6, the end caps 74 include a threaded connector 76 for threading into the threaded bore 70 and extending into the threaded apertures 54 of the vertical support members 50 (FIG. 1). Such an arrangement allows for the horizontal support member 52 to be releasably secured to the vertical support members 50.

An insert 78 is adapted to fit to the groove 64 for protecting the horizontal support member 52 while also reducing the frictional forces associated with the slidable engagement between the horizontal support member and the bridge 62 (FIG. 1).

A pair of wedged portions 80 extend from the respective ends of the insert 78 for protecting the horizontal support member 52 and guiding the bridge 62 (FIG. 1) on the horizontal support member. A pair of spaced tabs 82 extend from the respective longitudinal edges of the insert 78 for engaging the groove 64 in a snap-fit engagement.

In operation, and referring to FIG. 1, the towers 12 and 14 are assembled as stand-alone pieces. The vertical support members 50 are then threaded into the top plate 48 of the tower 14 to receive the horizontal support member 52.

The horizontal support member 52 is then engaged with the vertical support members 50 in the manner described above and adjusted along the vertical support members to a desired position corresponding to any of the plurality of threaded apertures 54. The end caps 74 are then threaded into the threaded bores 70 (FIG. 6) and into the threaded apertures 54 to releasably secure the horizontal support member 52 to the vertical support members 50. One end of the bridge 62 is then quick-connected to the tower 12 via cap screws while the opposite end is placed on the insert 78 (FIGS. 5 and 6), and therefore the horizontal support member 52.

The furniture assembly 10 can accommodate a variety of appliances, such as the television 16, of different sizes between the towers 12 and 14 by adjusting the space between the towers 12 and 14. As the position of the tower 14 is adjusted in this manner, the bridge 62 slides along the insert 78 connected to the horizontal support member 52, thereby adjusting the size of the furniture assembly 10. This is advantageous as no tools are required to manipulate the size of the furniture assembly 10 in a right or left direction, thus allowing for quick and easy adjustability of the furniture assembly. Of course, if it is desired to adjust the space between the towers 12 and 14 a significant amount, a new bridge can be substituted for the bridge 62.

Furthermore, the size of the furniture assembly 10 is quickly and easily adjustable in a vertical direction. To accomplish such adjustment, the bridge 62 is disconnected from the tower 12 and the horizontal support member 52 is released from the vertical support members 50 by unthreading the end caps 74 from the threaded apertures 54. The horizontal support member 52 is then adjusted in a vertical direction and secured to the vertical support members 50 via the end caps 74 and any of the plurality of apertures 54 formed in the vertical support members.

One end of the bridge 62 is then reconnected to the tower 12 at a position corresponding to the adjusted position of the horizontal support member 52. The opposite end of the bridge 62 is then placed on the insert 78 (FIGS. 5 and 6), and therefore the horizontal support member 52, thereby completing adjustment of the furniture assembly 10 in an upper or lower direction.

ALTERNATES AND EQUIVALENTS

Referring to FIGS. 7-11, an alternative horizontal support member 90 may be used with the furniture assembly 10 (FIG. 1). A pair of diametrically opposed slots 92 are formed through the middle of the horizontal support member 90 for receiving the bridge 62 (FIG. 1) in a slidable engagement. The slots 92 define a pair of end portions 94 of the horizontal support member 90. A pair of diametrically opposed apertures 96 are formed radially through the end portions 94 to engage the horizontal support member 90 with the vertical support members 50 (FIG. 1).

A threaded bore 98 is formed longitudinally through a solid portion 100 of the end portions 94 for receiving a pair of end caps 102. The end caps 102 include a threaded connector 104 for threading into the threaded bore 98 and further threading into the threaded apertures 54 of the vertical support members 50 (FIG. 1). Such an arrangement allows for the horizontal support member 90 to be releasably secured to the vertical support members 50, as discussed in the previous embodiment.

Figure 10:
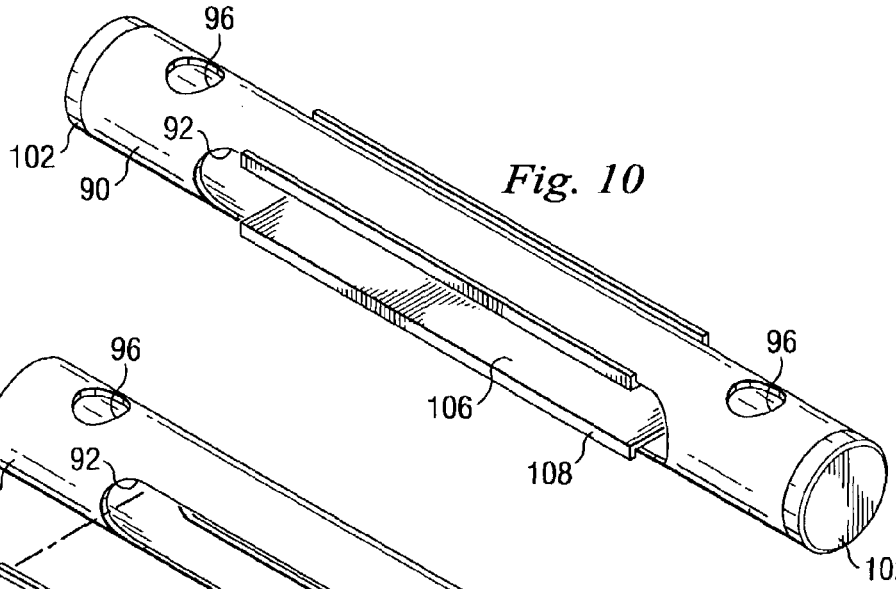
FIG. 10 is a perspective view of the horizontal support member of FIG. 7 with additional elements.
Figure 11:
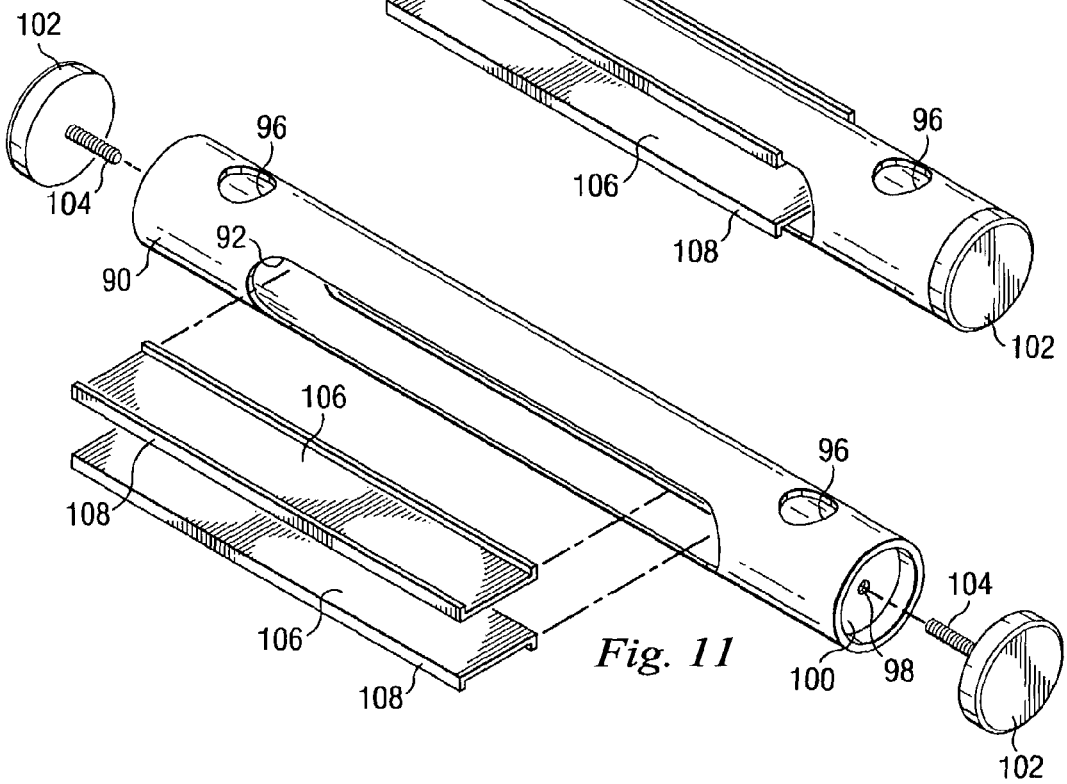
FIG. 11 is an exploded view of the horizontal support member of FIG. 10.

Referring to FIGS. 10 and 11, a pair of inserts 106 are adapted to fit to the slots 92 for protecting the horizontal support member 90 while also reducing the frictional forces associated with the slidable engagement between the horizontal support member and the bridge 62 (FIG. 1). A pair of tabs 108 extend from the respective longitudinal edges of the inserts 106 for engaging the slots 92 in a snap-fit engagement.

In operation, the horizontal support member 90 allows the bridge 62 to slide there through via the slot 92 during adjustment of the furniture assembly 10 in a right or left direction. Furthermore, the horizontal support member 90 and the bridge 62 are adjustable in a vertical direction to adjust the size of the furniture assembly 10 in a vertical direction. Thus, the embodiment of FIGS. 7-11 enjoys the advantages of that of FIGS. 2-6 with respect to permitting relatively quick and easy adjustability of the furniture assembly 10.

While the invention has been particularly shown and described with reference to embodiments thereof, it is understood by those skilled in the art that various changes in form and detail may be made therein without departing from the spirit and scope of the invention. For example, the furniture assembly 10 may house a variety of appliances and/or various other objects other than the television 16. Further, the towers 12 and 14 can be in the form of any type of support assembly. Also, the towers 12 and 14 may take a variety of shapes and designs and are not limited to the structure as described. As such, the towers 12 and 14 may each include the vertical support members 50 and the horizontal support member 52. Further, a horizontal bridge, similar to the bridge 62, can be placed between the towers 12 and 14 to form a support for a non-floorstanding television.

Still further, the vertical support members 50 may connect to the tower 14 in a variety of ways other than via a threaded connection, and the vertical support members 50 may be constructed as a stand-alone piece, thereby eliminating the need for the tower 14. Moreover, the bridge 62 may take a variety of shapes or sizes so long as the adjustability of the furniture assembly 10 is not compromised. Furthermore, the threaded apertures 54 formed in the vertical support members 50 may accommodate a plurality of horizontal support members 52, thereby allowing for a plurality of corresponding bridges 62 to be used with the furniture assembly 10.

Still further, although the vertical support members 50 and the horizontal support member 52 are depicted as being tubes, the support members may be constructed as being partially or substantially solid, and as such, may be formed as rods. Furthermore, although the vertical support members 50 and the horizontal member 52 are depicted as having a circular cross-section, the vertical support members and the horizontal support member may take a variety of shapes having a variety of different cross-sections.

Moreover, the end caps 74 may connect to the horizontal support member 52 in a variety of ways other than via the threaded connection. Furthermore, the horizontal support member 52 may engage the vertical support members 50 in ways other than via a pair of end caps 74. For example, the end portions 66 of the horizontal support member 52 may extend through diametrically opposed apertures formed through the vertical support members 50 to engage the horizontal support member to the vertical support members. Various means such as a washer may be used to retain the horizontal support member 52 on the vertical support members 50.

Still further, the horizontal member 52 may be removed and the bridge 62 may rest on and slidably engage screws or pins that engage the vertical support members 50. Furthermore, the insert 78 is optional and may not be used with the present disclosure.

It is also understood that all spatial references, such as "horizontal", "vertical", "top," "lower," "left," "right," "radial," and "longitudinal" are for illustrative purposes only be varied within the scope of the invention. Accordingly, all such modifications are to be included within the scope of this invention as defined in the following claims.

What is claimed is:

1. An adjustable fumiture assembly, comprising:

a first tower and a second tower, wherein the second tower is shorter than the first tower;

a bridge connected to the first tower;

a pair of vertical support members spaced apart from the first tower and connected to the second tower; and a horizontal support member connected to the vertical support members;

wherein the horizontal support member receives the bridge in a slidable engagement, wherein the horizontal support member comprises a pair of end caps releasably securing the horizontal support member to the vertical support members, and wherein the end caps comprise a threaded connector connecting to a threaded bore formed through a portion of the horizontal support member and further connecting to a threaded aperture formed in the vertical support members.

2. The furniture assembly of claim 1 wherein the vertical support members and the horizontal support member are tubes.

3. The furniture assembly of claim 1 wherein the vertical support members and the horizontal support member are rods.

4. An adjustable furniture assembly, comprising:

a first tower and a second tower, wherein the second tower is shorter than the first tower;

a bridge connected to the first tower;

a pair of vertical support members spaced apart from the first tower and connected to the second tower, and a horizontal support member connected to the vertical support members;

wherein the horizontal support member receives the bridge in a slidable engagement, wherein the horizontal support member receives the bridge via a groove formed in the horizontal support member, and wherein the horizontal support member comprises an insert for engaging the groove and for reducing frictional forces associated with the slidable engagement between the bridge and the horizontal support member; and wherein the horizontal support member comprises a pair of end caps releasably securing the horizontal support member to the vertical support members, and wherein the end caps comprise a threaded connector connecting to a threaded bore formed through a portion of the horizontal support member and further connecting to a threaded aperture formed in the vertical support members.

5. The furniture assembly of claim 4 wherein the vertical support members and the horizontal support member are tubes.

6. The furniture assembly of claim 4 wherein the vertical support members and the horizontal support member are rods.

7. An adjustable furniture assembly, comprising:

a first tower and a second tower, wherein the second tower is shorter than the first tower;

a bridge connected to the first tower;

a pair of vertical support members spaced apart from the first tower and connected to the second tower, and a horizontal support member connected to the vertical support members:

wherein the horizontal support member receives the bridge in a slidable engagement, wherein the horizontal support member receives the bridge via a slot formed through the horizontal support member, and wherein the horizontal support member comprises an insert for engaging the slot and for reducing frictional forces associated with the slidable engagement between the bridge and the horizontal support member; and wherein the horizontal support member comprises a pair of end caps releasably securing the horizontal support member to the vertical support members, and wherein the end caps comprise a threaded connector connecting to a threaded bore formed through a portion of the horizontal support member and further connecting to a threaded aperture formed in the vertical support members.

8. The furniture assembly of claim 7 wherein the vertical support members and the horizontal support member are tubes.

9. The furniture assembly of claim 7 wherein the vertical support members and the horizontal support member are rods.

* * * * *